US012123181B1

(12) United States Patent
Chen

(10) Patent No.: US 12,123,181 B1
(45) Date of Patent: Oct. 22, 2024

(54) FLUID SUPPLY FAUCET

(71) Applicant: HOKWANG INDUSTRIES CO., LTD., New Taipei (TW)

(72) Inventor: Kuan-Jen Chen, New Taipei (TW)

(73) Assignee: HOKWANG INDUSTRIES CO., LTD., New Taipei (TW)

( * ) Notice: Subject to any disclaimer, the term of this patent is extended or adjusted under 35 U.S.C. 154(b) by 84 days.

(21) Appl. No.: 18/194,935

(22) Filed: Apr. 3, 2023

(51) Int. Cl.
*E03C 1/05* (2006.01)
*A47K 5/12* (2006.01)

(52) U.S. Cl.
CPC ..... *E03C 1/057* (2013.01); *A47K 5/1217* (2013.01); *A47K 2005/1218* (2013.01); *Y10T 137/9464* (2015.04)

(58) Field of Classification Search
CPC ..... E03C 1/057; A47K 5/1217; A47K 2005/1218; A47K 4/00; Y10T 137/9464
USPC ..... 137/801
See application file for complete search history.

(56) References Cited

U.S. PATENT DOCUMENTS 6,598,245 B2 * 7/2003 Nishioka ..... E03C 1/057 4/304
7,228,874 B2 6/2007 Bolderheij et al.
9,347,207 B2 * 5/2016 Chen ..... F16K 11/074
9,758,953 B2 * 9/2017 Bayley ..... A61L 9/16
2015/0216369 A1 * 8/2015 Hamilton ..... G08B 21/245 222/23

FOREIGN PATENT DOCUMENTS

CN 108916464 11/2018
CN 113688964 11/2021
JP 2002146869 5/2002

* cited by examiner

*Primary Examiner* — John Bastianelli
(74) *Attorney, Agent, or Firm* — MUNCY, GEISSLER, OLDS & LOWE, P.C.

(57) ABSTRACT

A fluid supply faucet includes a faucet body, a plurality of fluid supply ports arranged in the faucet body, and a supply control module arranged on the faucet body. A plurality of fluids separately provided by the fluid supply ports are different. The supply control module includes a camera facing towards the supply position and an information processing unit connected to the camera. The information processing unit performs image recognition on image data output by the camera to determine, with a human body surface area contained in the image data, that one of the fluid supply ports supplies the fluid to the supply position. The information processing unit performs recognition of at least one of the features on the human body surface area: a non-skin tone high-brightness feature and a circular foam feature.

8 Claims, 6 Drawing Sheets

FLUID SUPPLY FAUCET

FIELD OF THE INVENTION

The invention relates to a fluid supply faucet, and more particularly, to a fluid supply faucet that supplies a corresponding fluid based on an image recognition result.

BACKGROUND OF THE INVENTION

Japanese Patent Publication No. JP2002-146869A, Chinese Patent Publication Nos. CN108916464A, CN113688964A, U.S. Pat. No. 7,228,874B2 have disclosed embodiments of supply faucets that can provide multiple fluids. For JP2002-146869A and CN108916464A, it requires the user to drive the supply faucet with a specific gesture to provide the corresponding fluid during the implementation. However, gesture control would be disadvantageous to a first-time user who does not receive the gesture teaching and would not be convenient when being opened to the public.

With regard to CN113688964A, it is determined to provide a fluid by judging the position of a user's hand, which is actually a change in the implementation of a gesture. It is still inconvenient for the user to remember how to operate.

Finally, in U.S. Pat. No. 7,228,874B2, it is carried out with a sensor which determines the kind of fluid to be supplied by the number of times the sensor is close to the supply faucet. The embodiment is susceptible to being triggered by an erroneous approach by the user when using. As it is judged by the number of approaches, there is a problem that the supplied fluid does not correspond to the current requirement of the user, which wastes the supplied fluid.

SUMMARY OF THE INVENTION

The main object of the invention is to solve the problems of the conventional techniques.

To achieve the above object, the invention provides a fluid supply faucet including a faucet body, a plurality of fluid supply ports arranged in the faucet body, and a supply control module arranged on the faucet body. The plurality of fluid supply ports all face towards a supply position, wherein each of the plurality of fluid supply ports is connected to a fluid supply source outside the faucet body, the plurality of fluid supply ports supply fluid separately, and a plurality of fluids provided by the plurality of fluid supply ports are different. The supply control module includes a camera facing towards the supply position and an information processing unit connected to the camera, the information processing unit is disposed to recognize an image data output by the camera to determine which of the plurality of fluid supply ports supplies the fluid to the supply position base on a human body surface area in the image data, and the information processing unit is disposed to recognize at least one feature on the human body surface area: a non-skin tone high-brightness feature and a circular foam feature.

In an embodiment, the fluid supply faucet includes a status indicating element arranged on the faucet body and in communication with the information processing unit.

In an embodiment, the status indicating element is a display screen.

In an embodiment, the plurality of fluids are a water, a soap solution, and a hand drying air, respectively.

In an embodiment, the faucet body comprises a fitting end and a free end opposite to the fitting end, and one of the plurality of fluid supply ports supplying the hand drying air is closer to the free end than the other plurality of fluid supply ports.

In an embodiment, the fluid supply faucet comprises a plurality of conduits arranged in the faucet body connecting the plurality of fluid supply ports and a plurality of fluid supply sources.

In an embodiment, the plurality of fluid supply ports are sequentially spaced from an end of the faucet body and the camera is positioned between any two of the plurality of fluid supply ports.

In an embodiment, the supply control module comprises a fill light element exposed from the faucet body.

According to the foregoing embodiment of the invention, the following features are provided in comparison with the conventional techniques. The invention performs image recognition on image data output from the camera with the information processing unit, performs recognition of at least one of the non-skin tone high-brightness feature and the circular foam feature on the surface area of the human body in the image data, and determines supply of the corresponding fluid based on the result. The fluid supply faucet of the invention eliminates the need to memorize cumbersome procedures, which is convenient for public use and reduces the chances that the user will falsely trigger during the scrubbing process.

DETAILED DESCRIPTION OF THE PREFERRED EMBODIMENTS

Figure 1:
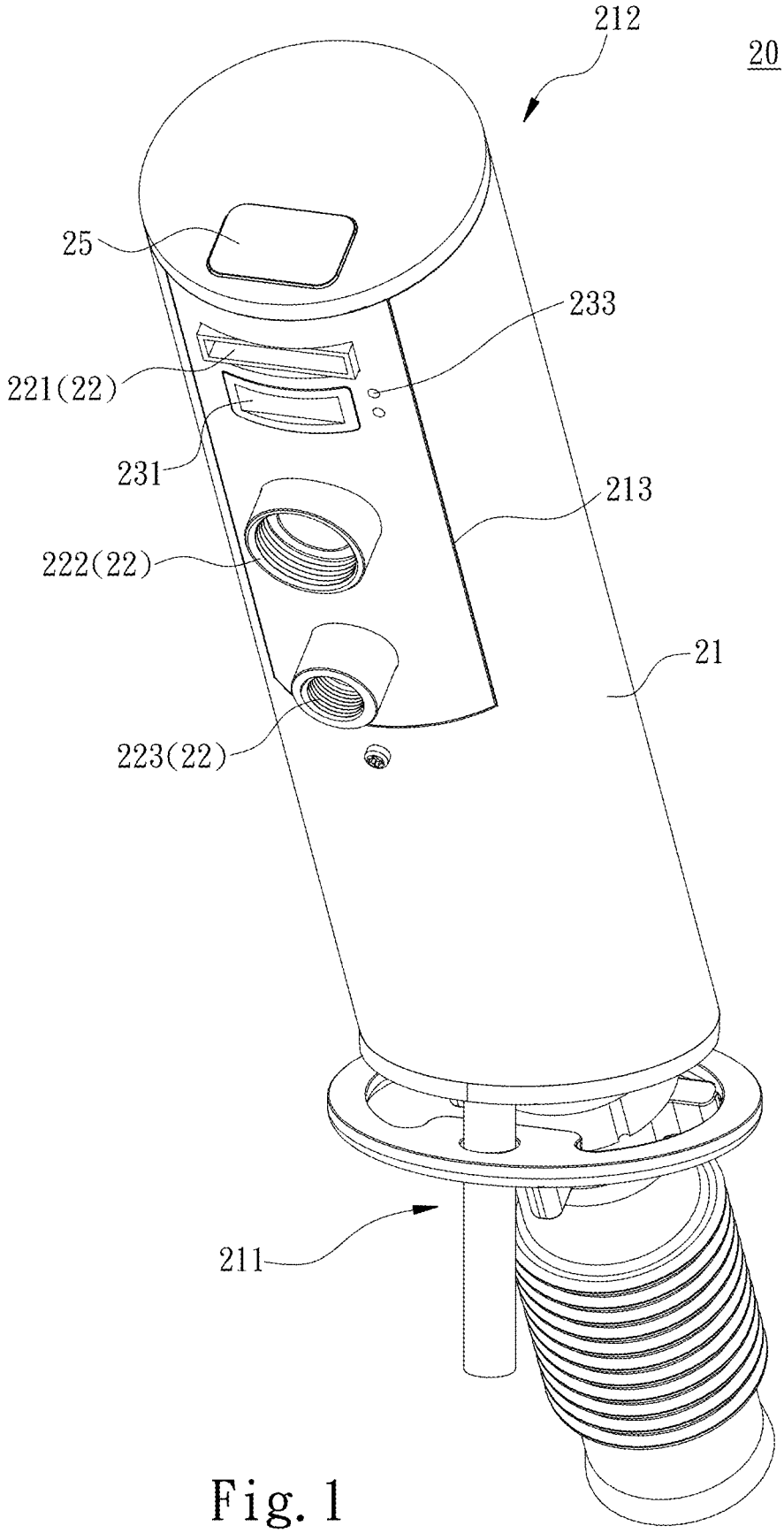
FIG. 1 is a schematic view of an embodiment of a fluid supply faucet according to the invention.
Figure 2:
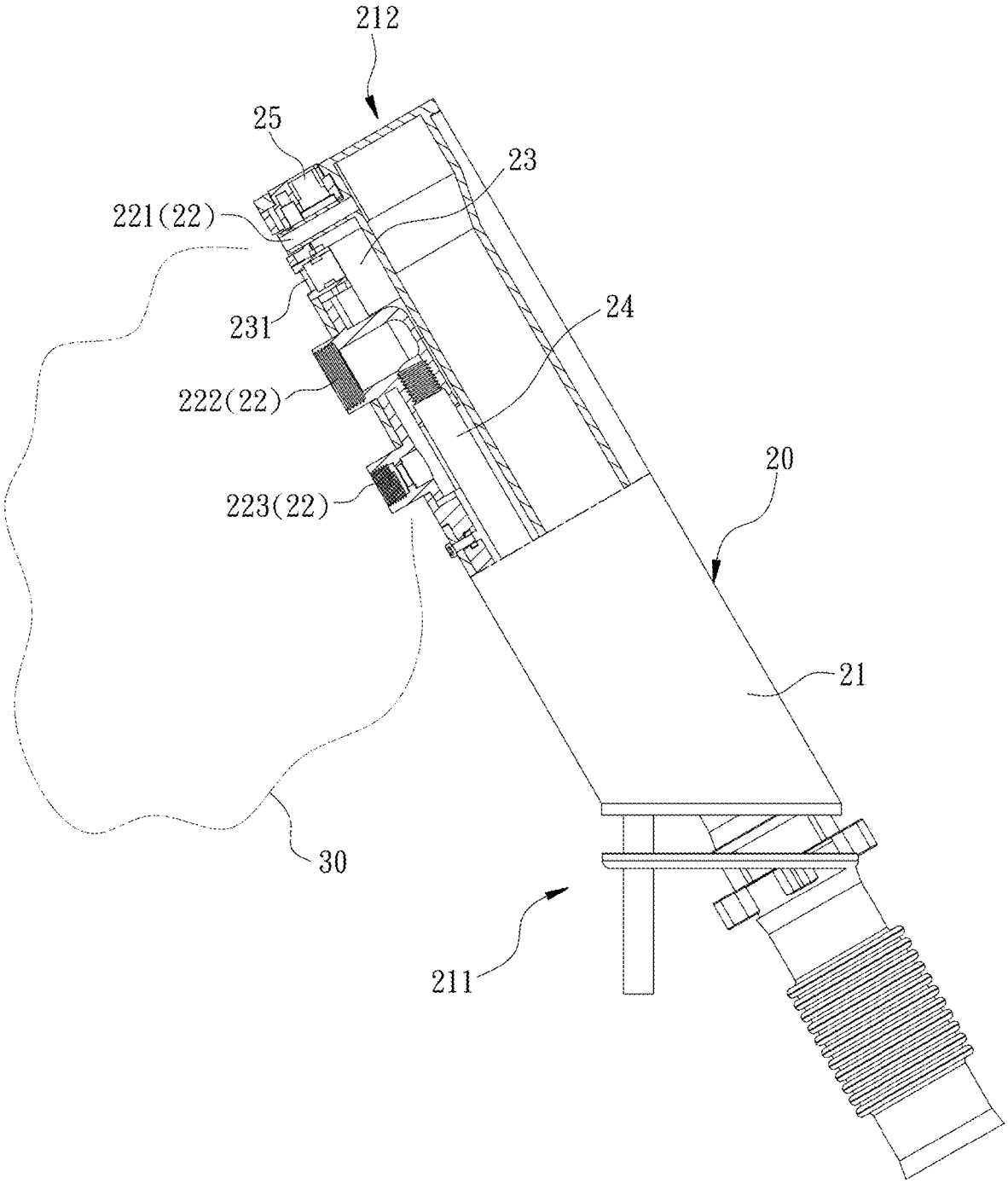
FIG. 2 is a schematic partial cross-sectional view of the embodiment of the fluid supply faucet according to the invention.

The detailed description and technical contents of the invention are now described with reference to the drawings as follows.

Referring to FIG. 1, FIG. 2, FIG. 3, and FIG. 4, the invention provides a fluid supply faucet 20 provided with a supply position 30. The supply position 30 is where a user receives fluid supplied from the fluid supply faucet 20. The supply position 30 is not a structural part of the fluid supply faucet 20, and the supply position 30 is defined according to the structure of the fluid supply faucet 20. The fluid supply faucet 20 includes a faucet body 21, a plurality of fluid supply ports 22 arranged on the faucet body 21, and a supply control module 23 arranged on the faucet body 21. The faucet body 21 is integrally formed or assembled from a plurality of housing pieces. The faucet body 21 is hollow therein to provide additional component assembly. The faucet body 21 includes a fitting end 211 and a free end 212 opposite to the fitting end 211. The faucet body 21 is assembled with an external structure such as a furniture structure or a toilet facility. Furthermore, the plurality of fluid supply ports 22 are provided on a position of the faucet body 21 closer to the free end 212, the plurality of fluid supply ports 22 are arranged as a module in an opening 213 of the faucet body 21, the plurality of fluid supply ports 22 each being exposed on the surface of the faucet body 21, the plurality of fluid supply ports 22 each facing towards the supply position 30. In other words, the supply position 30 is defined by the plurality of fluid supply ports 22. Further, each of the plurality of fluid supply ports 22 is connected to a fluid supply source 31 outside the faucet body 21. The plurality of fluid supply ports 22 supply fluid separately, and a plurality of fluids provided by the plurality of fluid supply ports 22 are different. In an embodiment, the plurality of fluids are a water, a soap solution, and a hand drying air. In this embodiment, a plurality of fluid supply sources 31 are a soap dispenser 32, a hand drying air generator 33, and a water source 34, respectively. Further, the fluid supply faucet 20 includes a plurality of conduits 24 arranged in the faucet body 21 for connecting the plurality of fluid supply ports 22 and the fluid supply sources 31.

Referring to FIG. 1, FIG. 2, FIG. 3, and FIG. 4, the supply control module 23 includes a camera 231 facing towards the supply position 30, and an information processing unit 232 connected to the camera 231. In an embodiment, the hand drying air generator 33 is a power source of the supply control module 23. An external power source 60 is a power source of the hand drying air generator 33. A power conversion module of the hand drying air generator 33 converts a power level of the external power source 60 to a power level available to the supply control module 23. In addition, the hand drying air generator 33 is a power source for the soap dispenser 32 and the water source 34. In another embodiments, the fluid supply faucet 20 is connected directly to the external power source 60 to obtain the power required for operation.

Figure 5:
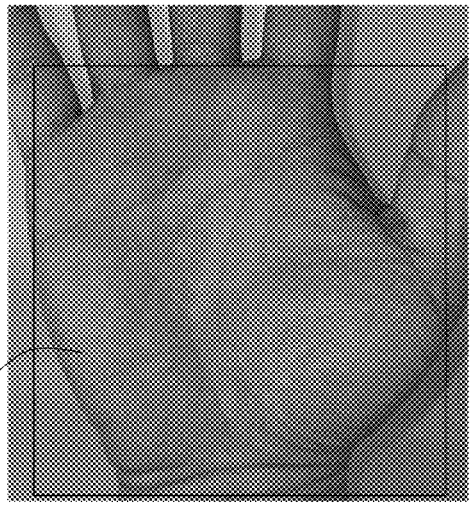
FIG. 5 is a schematic view (I) of image data implementation according to the invention.
Figure 6:
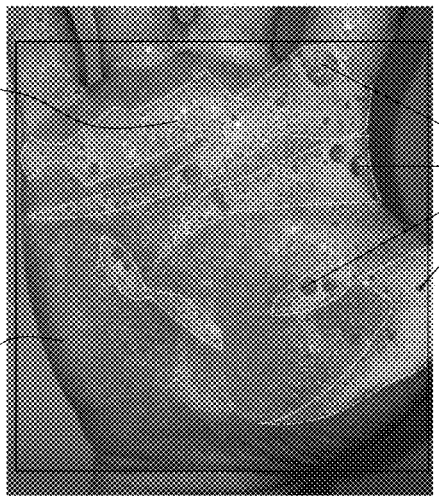
FIG. 6 is a schematic view (II) of image data implementation according to the invention.
Figure 7:
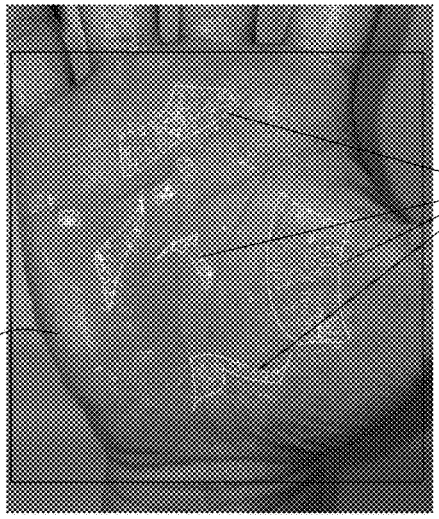
FIG. 7 is a schematic view (III) of image data implementation according to the invention.

In addition, the camera 231 includes a lens (not shown), and an imaging unit (not shown) optically connected to the lens. When the camera 231 is activated, image data 40 is outputted to the information processing unit 232. Viewing the image data 40 in the form of an image, the current condition of the supply position 30, such as a condition of a user's hand close to the supply position 30, is obtained from the image data 40. The information processing unit 232 is an electronic module, and the information processing unit 232 is not limited to recognizing image and triggering a plurality of the fluid supply sources 31. An operation processor (not shown) of the information processing unit 232 is configured to recognize image, and the operation processor processes the image data 40 by a memorized operation program. Accordingly, the information processing unit 232 determines which of the plurality of fluid supply ports 22 to supply the fluid to the supply position 30 based on a human body surface area 41 included in the image data 40. Referring to FIG. 5, FIG. 6, and FIG. 7, the information processing unit 232 performs recognition of at least one feature on the human body surface area 41: a non-skin tone and high-brightness feature 42 and a circular foam feature 43. The recognition of above-mentioned two features is respectively defined on the basis of the case where the human skin surface is wet and the human skin surface has soap solution. Furthermore, the non-skin tone and high-brightness feature 42 is judged on the basis of light reflection due to water. The circular foam feature 43 is judged on the basis of whether the human body surface area 41 has a plurality of circle patterns with different sizes and densities.

The fluid supply faucet 20 is illustrated as supplying the water, the soap solution, and the hand drying air. However, it should be understood that the fluid supply faucet 20 of the invention, in addition to providing the necessary supply of water, the fluid supply faucet 20 is optionally assembled with portions of the soap solution and the hand drying air according to implementation needs, which is the soap solution implemented with the water or the hand drying air implemented with the water. When using the fluid supply faucet 20 of the invention, the user simply positions the human body part to be cleaned in the supply position 30, and the camera 231 outputs the image data 40 including the human body part to the information processing unit 232. The information processing unit 232 recognizes the human body surface area 41 in the image data 40. If the recognition result is that the human body surface area 41 is not wet, namely, the non-skin tone high-brightness feature 42 and the circular foam feature 43 are not present, the soap solution is provided. The information processing unit 232 identifies the image data 40 continuously provided by the camera 231. The information processing unit 232 identifies whether foam is present in the human body surface area 41. If the circular foam feature 43 and the non-skin tone high-brightness feature 42 are present, the water is supplied. It should be noted that the information processing unit 232 sets a buffer time to prevent erroneous supply (e.g., the water erroneously supplied while the user is scrubbing the skin of the body with the soap solution). While the information processing unit 232 continuously recognizes the image data 40, if the human body surface area 41 is recognized as only being wet, i.e., that the non-skin tone high-brightness feature 42 is present but the circular foam feature 43 is not present, the hand drying air is supplied. Thus, the fluid supply faucet 20 of the invention does not require a user to remember an operating gesture, which is convenient for public use and reduces the chance that the user will falsely trigger during scrubbing.

Figure 8:
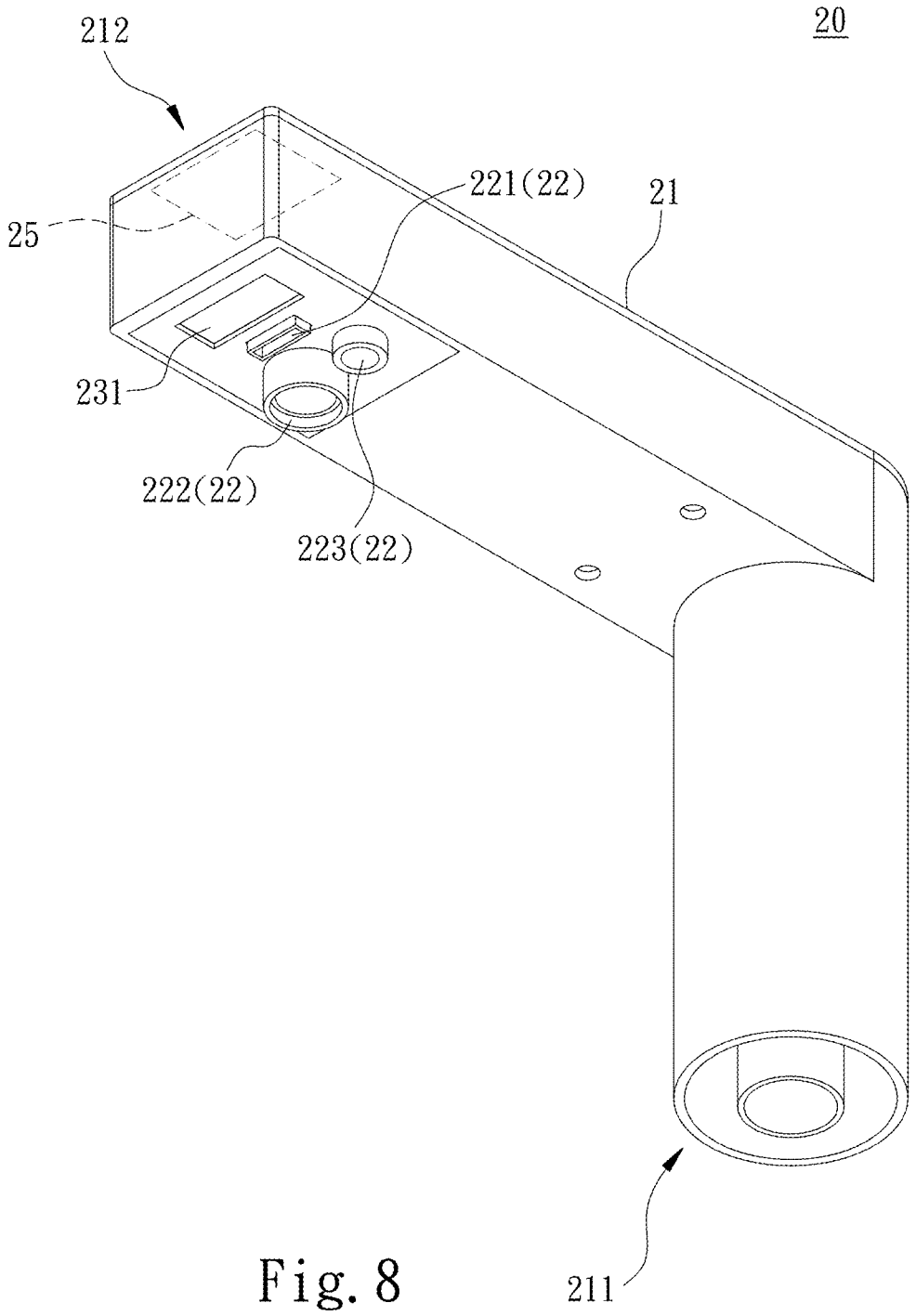
FIG. 8 is a schematic view of another embodiment of a fluid supply faucet according to the invention.

Referring to FIG. 1 and FIG. 8, in an embodiment, the fluid supply faucet 20 includes a status indicating element 25 arranged on the faucet body 21 and in communication with the information processing unit 232. The status indicating element 25 indicates the current supplier based on at least one signal from the information processing unit 232, i.e., when the fluid supply faucet 20 is supplying the water, the status indicating element 25 generates a visual indicating that the water is being supplied. The visual prompt is an image, a continuous image, or a light. In an embodiment, the status indicating element 25 is a display screen.

Figure 3:
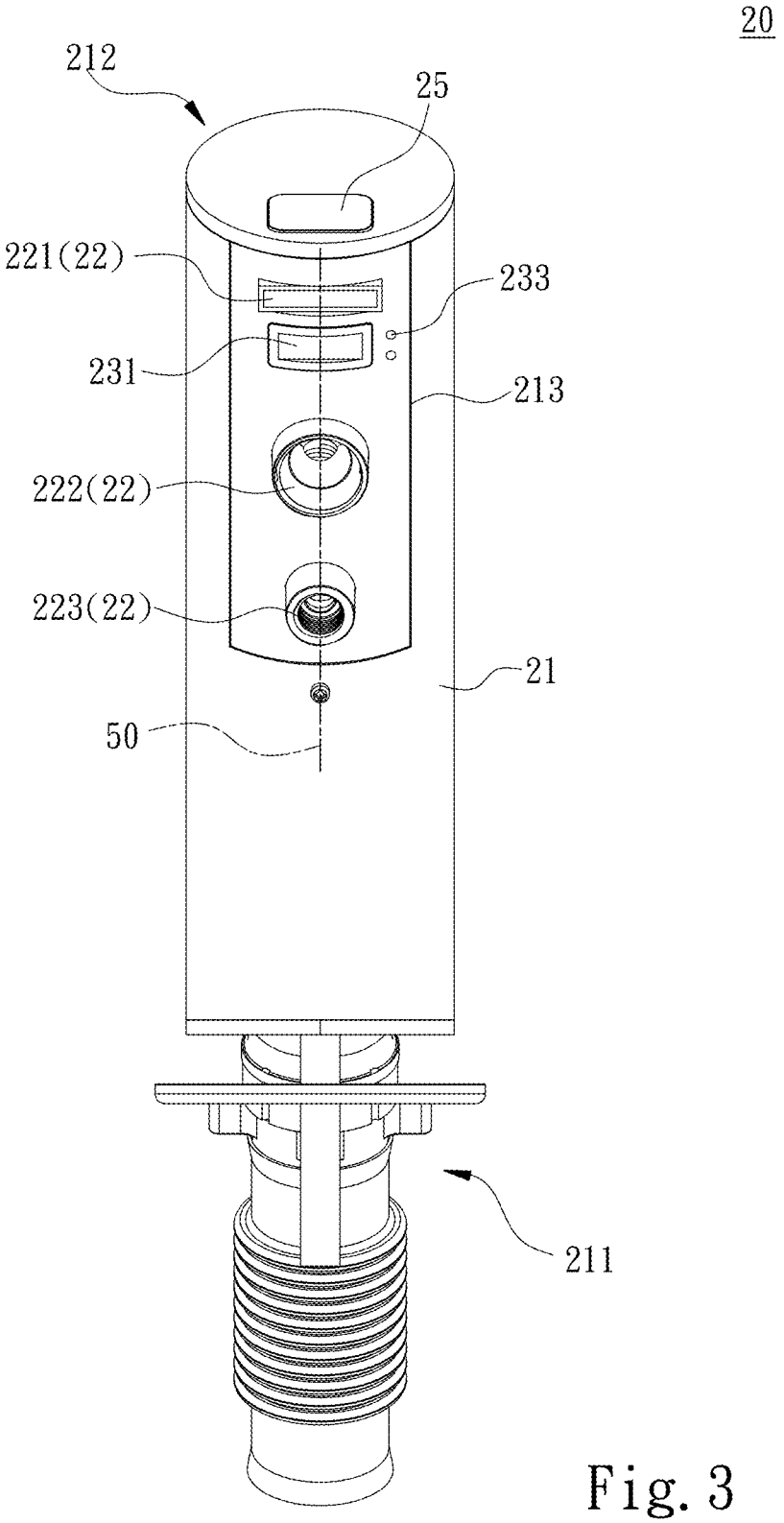
FIG. 3 is a schematic view in another direction of the embodiment of the fluid supply faucet according to the invention.

Referring to FIG. 1 and FIG. 3, in an embodiment, the supply control module 23 includes a fill light element 233 exposed from the faucet body 21. The fill light element 233 faces towards the supply position 30. The fill light element 233 generates a visible light or a non-visible light after being activated. The fill light element 233 supplies a secondary light to achieve a fill light effect for the camera 231 when generating the image data 40, so that the image brightness of the image data 40 better meets the requirements of image identification.

Figure 4:
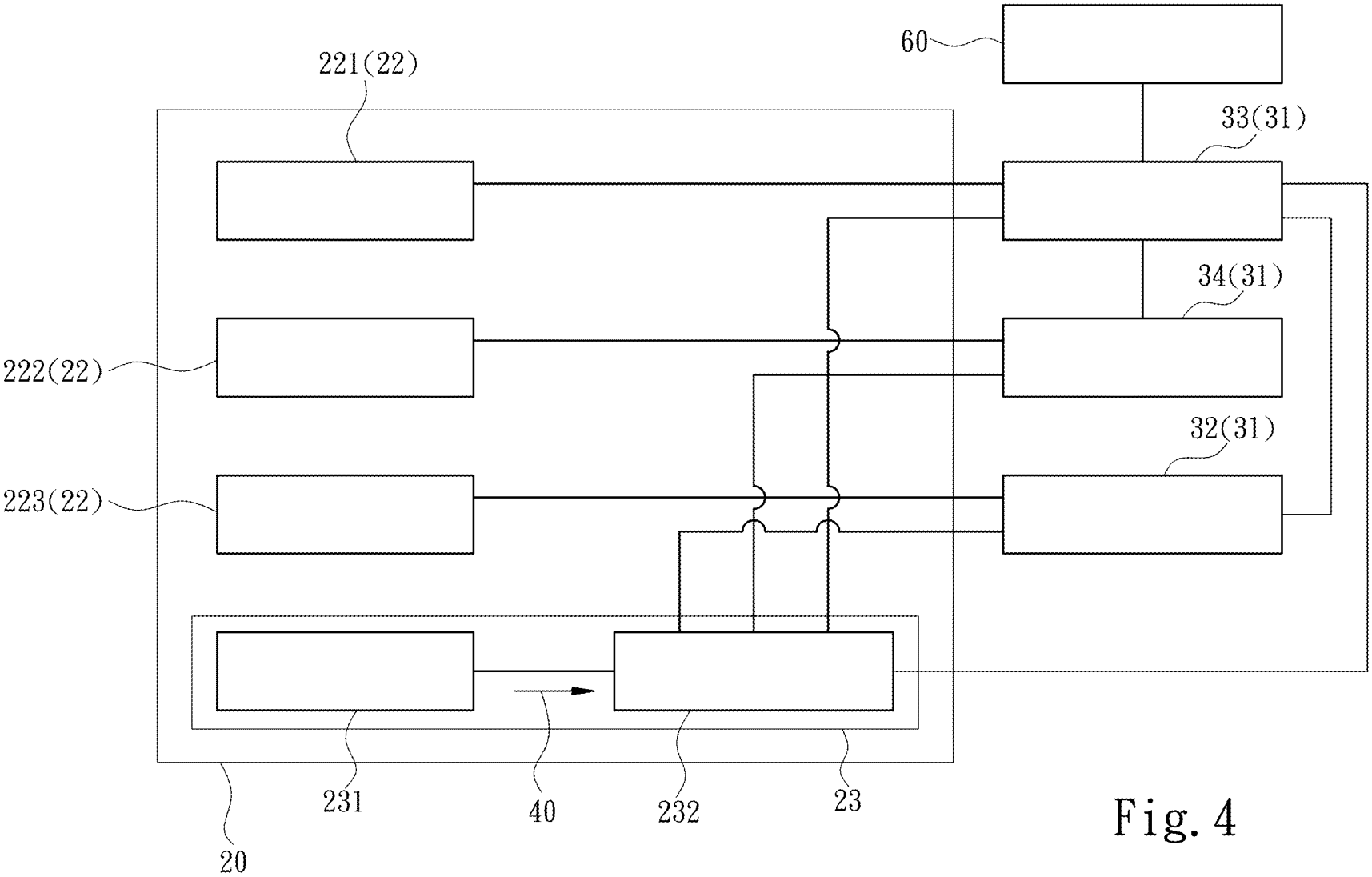
FIG. 4 is a schematic view of an implementation unit of the embodiment of the fluid supply faucet according to the invention.

Referring to FIG. 3, in an embodiment, the plurality of fluid supply ports 22 are sequentially spaced from an end of the faucet body 21 and the camera 231 is positioned between any two of the plurality of fluid supply ports 22. Further, the plurality of fluid supply ports 22 and the camera 231 are arranged close to the free end 212 of the faucet body 21. The plurality of fluid supply ports 22 and the camera 231 are spaced along an imaginary line 50 or the positions thereof are determined based on the state supplying fluid. In the foregoing embodiment, one of the plurality of fluid supply ports 22 (shown as 221) supplying the hand drying air is closer to the free end 212 than the other plurality of fluid supply ports 22. That is, when the fluid supply faucet 20 is assembled, one of the plurality of fluid supply ports 22 for supplying the hand drying air (i.e., the hand drying air supply port 221) has a higher level height than level heights of the plurality of fluid supply ports 22. Thereby, the hand drying air effectively acts to provide a wide area of human skin within the supply position 30. Other two of the plurality of fluid supply ports 22, except the hand drying air supply port 221, are a water supply port (222 as shown in FIG. 4) and a soap supply port (223 as shown in FIG. 4). In one embodiment, the plurality of fluid supply ports 22 of the invention are configured as described in FIG. 8.

What is claimed is:

1. A fluid supply faucet, comprising:

a faucet body;

a plurality of fluid supply ports, arranged in the faucet body and all facing towards a supply position, wherein each of the plurality of fluid supply ports is connected to a fluid supply source outside the faucet body, the plurality of fluid supply ports supply fluid separately, and a plurality of fluids provided by the plurality of fluid supply ports are different; and a supply control module, arranged on the faucet body, wherein the supply control module comprises a camera facing towards the supply position and an information processing unit connected to the camera, the information processing unit is disposed to recognize an image data output by the camera to determine which of the plurality of fluid supply ports supplies the fluid to the supply position base on a human body surface area in the image data, and the information processing unit is disposed to recognize at least one feature on the human body surface area: a non-skin tone high-brightness feature and a circular foam feature.

2. The fluid supply faucet of claim 1, wherein the fluid supply faucet comprises a status indicating element arranged on the faucet body and in communication with the information processing unit.

3. The fluid supply faucet of claim 2, wherein the status indicating element is a display screen.

4. The fluid supply faucet of claim 3, wherein the plurality of fluids are a water, a soap solution, and a hand drying air, respectively.

5. The fluid supply faucet of claim 4, wherein the faucet body comprises a fitting end and a free end opposite to the fitting end, and one of the plurality of fluid supply ports supplying the hand drying air is closer to the free end than the other plurality of fluid supply ports.

6. The fluid supply faucet of claim 5, wherein the fluid supply faucet comprises a plurality of conduits arranged in the faucet body connecting the plurality of fluid supply ports and a plurality of fluid supply sources.

7. The fluid supply faucet of claim 1, wherein the plurality of fluid supply ports are sequentially spaced from an end of the faucet body and the camera is positioned between any two of the plurality of fluid supply ports.

8. The fluid supply faucet of claim 1, wherein the supply control module comprises a fill light element exposed from the faucet body.

* * * * *